US009283436B2

(12) United States Patent
Donahue et al.

(10) Patent No.: US 9,283,436 B2
(45) Date of Patent: Mar. 15, 2016

(54) COLLAPSIBLE SCUBA FIN WITH CAM LOCK FEATURE AND ADJUSTABLE BLADES

(71) Applicants: Christopher Alan Donahue, Bethalto, IL (US); Daniel Boyd Cichlar, Jr., Bethalto, IL (US); Paul Allen Robinson, Archer, FL (US)

(72) Inventors: Christopher Alan Donahue, Bethalto, IL (US); Daniel Boyd Cichlar, Jr., Bethalto, IL (US); Paul Allen Robinson, Archer, FL (US)

( * ) Notice: Subject to any disclaimer, the term of this patent is extended or adjusted under 35 U.S.C. 154(b) by 0 days.

(21) Appl. No.: 14/080,262

(22) Filed: Nov. 14, 2013

(65) Prior Publication Data

US 2015/0133010 A1 May 14, 2015

Related U.S. Application Data

(60) Provisional application No. 61/726,374, filed on Nov. 14, 2012.

(51) Int. Cl.
*A63B 31/11* (2006.01)
*A63B 31/16* (2006.01)

(52) U.S. Cl.
CPC ..... *A63B 31/11* (2013.01); *A63B 2031/112* (2013.01); *A63B 2209/00* (2013.01); *A63B 2210/50* (2013.01); *A63B 2225/09* (2013.01)

(58) Field of Classification Search
CPC ..... A63B 31/11
USPC ..... 441/61, 62, 63, 64
See application file for complete search history.

(56) References Cited

U.S. PATENT DOCUMENTS

| | | | | |
|---|---|---|---|---|
| 7,793,438 | B1 * | 9/2010 | Busse et al. | 36/105 |
| 7,997,948 | B2 * | 8/2011 | Fraser et al. | 441/64 |
| 8,382,543 | B1 | 2/2013 | Donahue | |
| 2013/0090028 | A1 * | 4/2013 | Mayer | 441/64 |

* cited by examiner

*Primary Examiner* — S. Joseph Morano
*Assistant Examiner* — Anthony Wiest

(57) ABSTRACT

Collapsible, adjustable scuba fin with a cam lock feature. The blades of the fin are set on an enclosed track in the foot plate which allows the blades to be extended to create a fin of variable surface area for different swimming conditions or retracted under the foot plate for walking. The blades can be locked in place by the cam lock which is attached to the foot plate by means of a screw and foot pocket by means of an adjustable pull lanyard. The foot pocket and heel hilt can be adjusted to accommodate feet and footwear of varying size, and style allowing a single fin to fit multiple individuals and requirements. A T-bolt slider set in the foot plate can be rotated or removed to access the space between the blades allowing for the clearing of debris.

17 Claims, 10 Drawing Sheets

Fig. 8
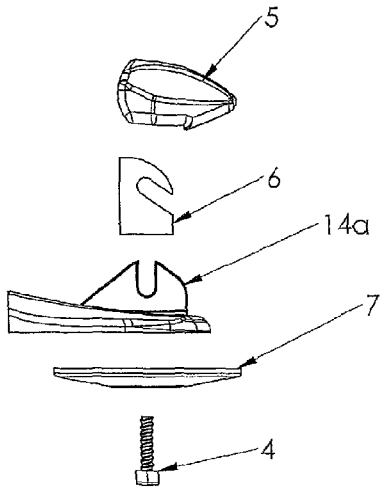
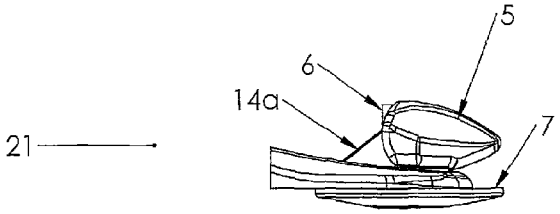
Fig. 9
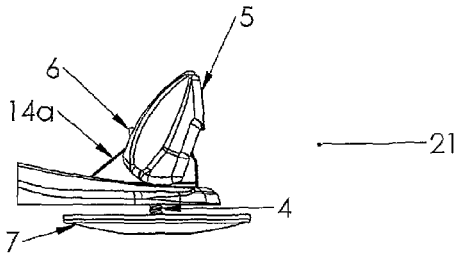
Fig. 10

COLLAPSIBLE SCUBA FIN WITH CAM LOCK FEATURE AND ADJUSTABLE BLADES

RELATED APPLICATION

The present application claims the benefit of U.S. Provisional Application No. 61/726,374, filed Nov. 14, 2012, the disclosure of which is hereby incorporated by reference.

FIELD OF THE INVENTION

The present invention relates to watersport technology. More specifically, the invention concerns a collapsible scuba fin.

BACKGROUND OF THE INVENTION

Currently scuba fins are generally formed of a single piece of material of a fixed length. This creates extra bulk when not in use and inhibits normal land-based activities like walking or running because of the length of the blade extending past the toes.

Furthermore, different lengths of fin blade provide different benefits while swimming; a longer blade with more surface area provides more thrust but requires more effort to use, while a smaller blade provides less thrust but requires less effort. Swimmers may therefore wish to possess several different fins for a variety of swimming environments.

Finally, the foot pocket area of a fixed swim fin is not adjustable, meaning that different fins must be produced for different sizes of foot.

DESCRIPTION OF THE PRIOR ART

Previous patent applications for an adjustable fin, U.S. Patent No. US20100317246 A1 and U.S. Pat. No. 8,382,543 B1, were granted for an adjustable fin apparatus that allowed the surface area of the blades to be adjusted. However, these previous blades have an open track allowing unwanted outward pivoting of the blades and also required three and five blades respectively. They did not allow the blades to be easily removed, and used a thumb screw system that did not allow for easy adjustment while wearing the fin. Furthermore, the construction did not allow for adjustment for different shoe sizes nor were they flexible enough to walk in easily with the blades retracted.

SUMMARY OF THE INVENTION

One aspect of the invention relates to an adjustable scuba fin apparatus that includes an adjustable pair of fin blades with fully enclosed tracks; and a cam lock adjustment system able to extend and retract the fin blades, setting variable lengths without the use of tools or excessive force by user. In one preferred embodiment, a T-Bolt Track and T-Bolt Slider mechanism lock the blades in place and allow their release for user defined adjustment without the use of tools or excessive force by user. In another preferred embodiment, the blades slide along a T-Bolt track on a foot plate. When this is the case, the adjustable scuba fin preferably further includes an adjustable height heel hilt attached with screws to the foot plate.

Alternatively, the adjustable scuba fin preferably further includes a foot pocket attached to the foot plate by adjustable straps. Still more preferably, the foot pocket is attached to the heel hilt by buckles. In yet another preferred embodiment wherein the blades slide along a T-Bolt track on a foot plate, the blades are locked in place by a cam lock system. When this is the case, the adjustable scuba fin further includes a foot pocket connected to the cam lock system. Still more preferably, the foot pocket is connected to the cam lock system by an adjustable pull lanyard. In still yet another preferred embodiment wherein the blades slide along a T-Bolt track on a foot plate, the foot plate contains a T-bolt slider which can be rotated to clear the space between the blades.

BRIEF DESCRIPTION OF THE DRAWINGS

Referring now to the drawings in which like reference numbers represent corresponding parts throughout.

FIG. 8 is a side view of the cam lock assembly in exploded view.

FIG. 9 is a side view of the cam lock assembly in the locked position.

FIG. 10 is a side view of the cam lock assembly in the unlock position.

DETAILED DESCRIPTION OF THE PREFERRED EMBODIMENT

Figure 1:
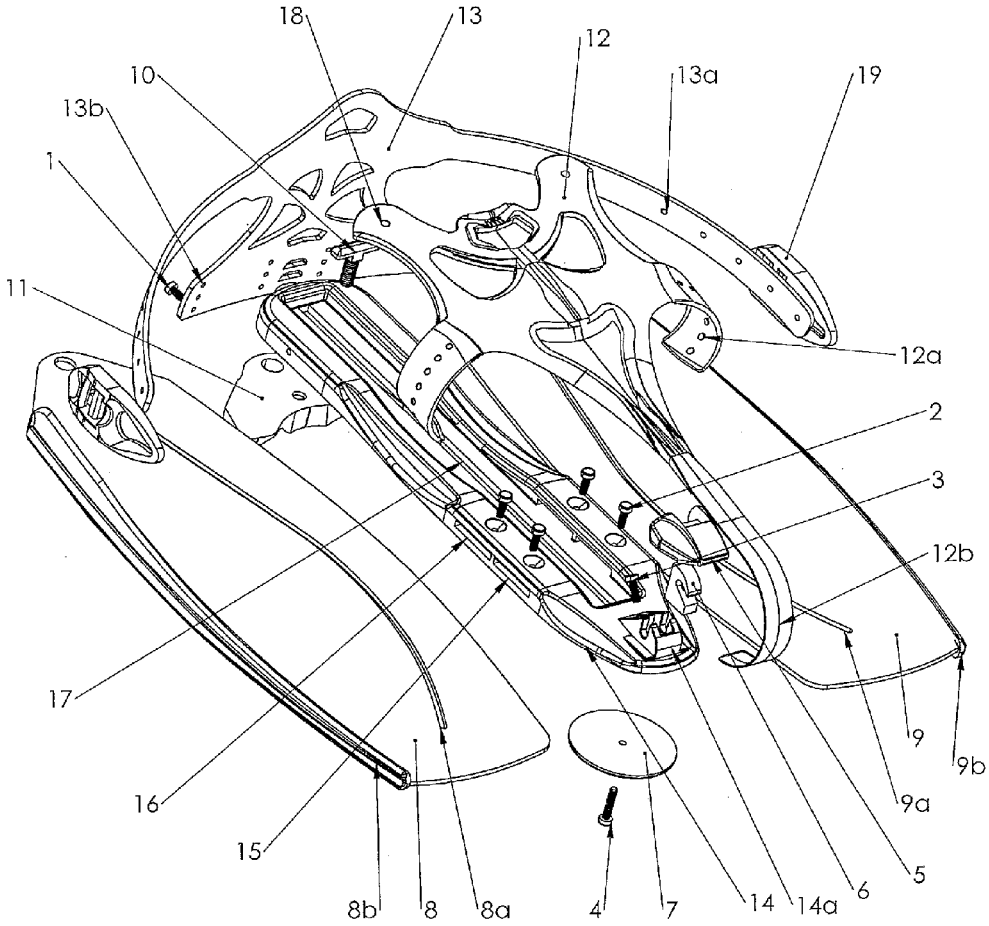
FIG. 1 is a plan view of the fin with parts exploded and numbered.
Figure 2A:
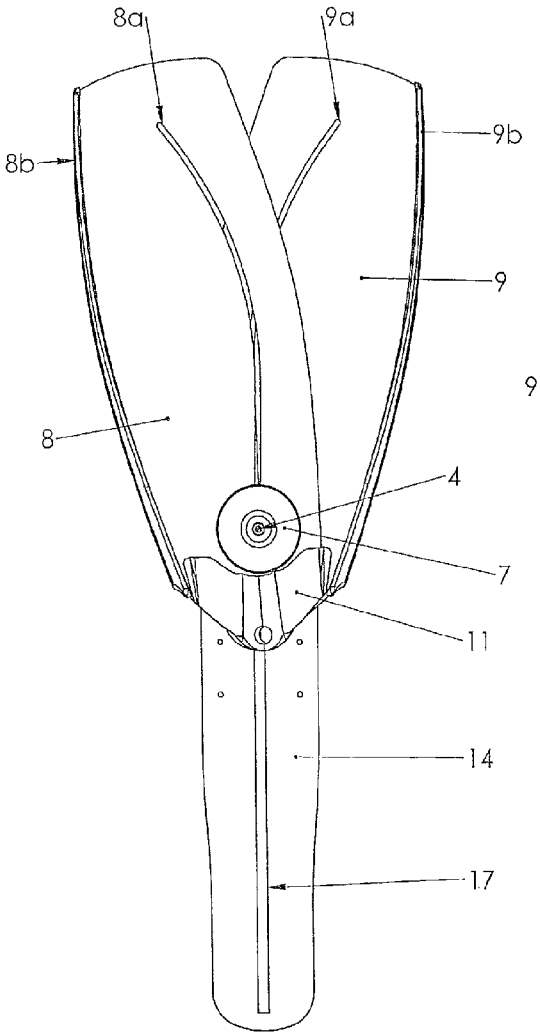
FIGS. 2*a* and 2*b* are a top and bottom view of the fin fully extended in open position.
Figure 2B:
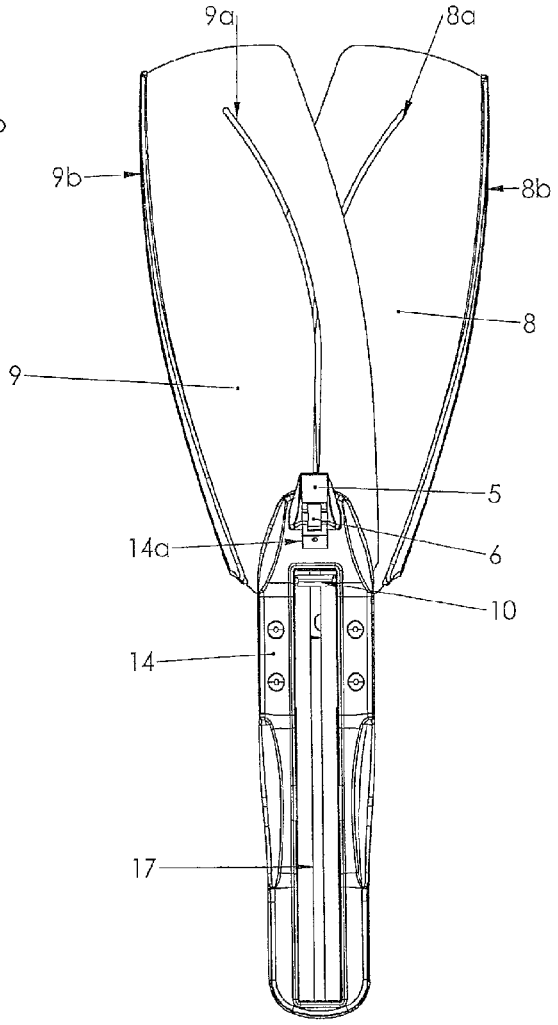
Figure 3A:
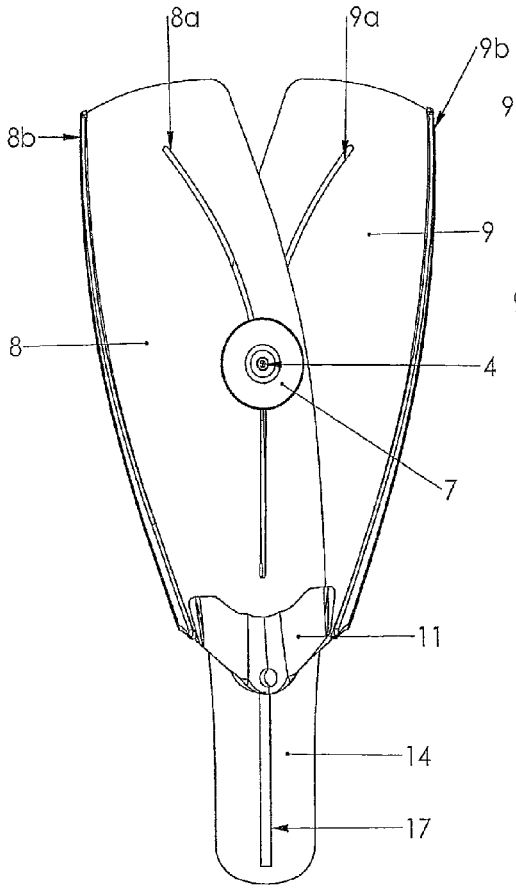
FIGS. 3*a* and 3*b* are a top and bottom view of the fin halfway open.
Figure 3B:
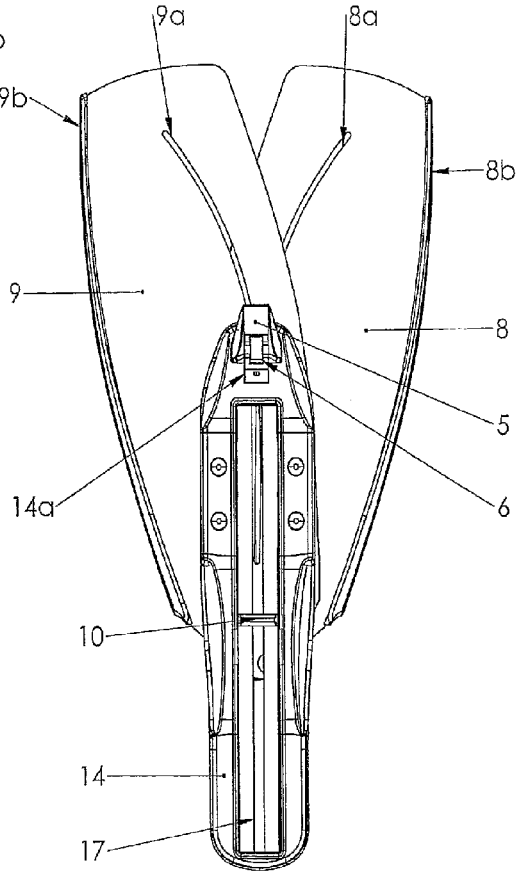
Figure 4A:
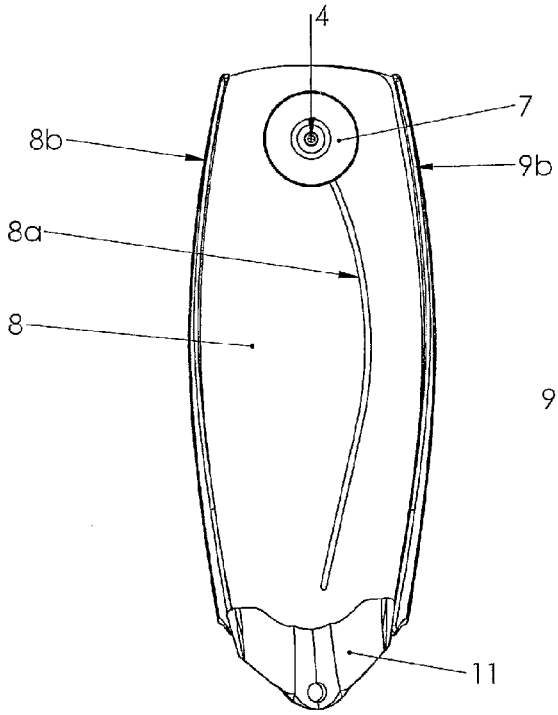
FIGS. 4*a* and 4*b* are a top and bottom view of the fin fully closed.
Figure 4B:
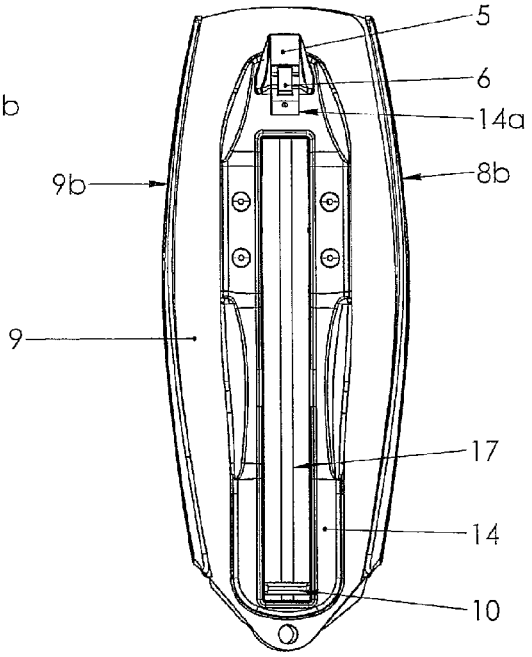

In the following description, reference is made to the accompanying drawings which form a part hereof, and which is shown, by way of illustration, several embodiments of the present invention. It is understood that other embodiments may be utilized and structural changes may be made without departing from the scope of the present invention.

The preferred embodiment is an adjustable fin 20 which a user can wear on the outside of appropriate footwear, generally a type of waterproof boot. The fin 20 can be adjusted for different sizes of feet and the blades 8, 9 can be extended to provide different swimming surfaces for different swimming situations.

Referring now to FIG. 1, FIG. 2*a*, FIG. 2*b*, FIG. 3*a*, FIG. 3*b*, FIG. 4*a*, FIG. 4*b*, FIG. 5, FIG. 6, and FIG. 7, wherein the drawings depict an embodiment of an adjustable fin 20. The adjustable fin 20 includes a right 8 and left 9 elongated blade formed of acrylonitrile butadiene styrene. Each fin 20 includes a rubber foot pad 11, a fully enclosed grooved track 8*a*, 9*a* and a rubber rail 8*b*, 9*b*. Both blades 8, 9 connect to the cam lock system 21 represented in FIG. 8, FIG. 9 and FIG. 10. The blades 8, 9 can be slid across the track 8*a*, 9*a* to extend or shorten the length the blades 8, 9 extend beyond the foot plate 14. The cam lever 5, along with the pull lanyard 12*b* from the foot pocket 12 can be used to engage the cam lock system 21 without the use of tools or excessive force by the user to hold the blades 8, 9 in position.

Figure 5:
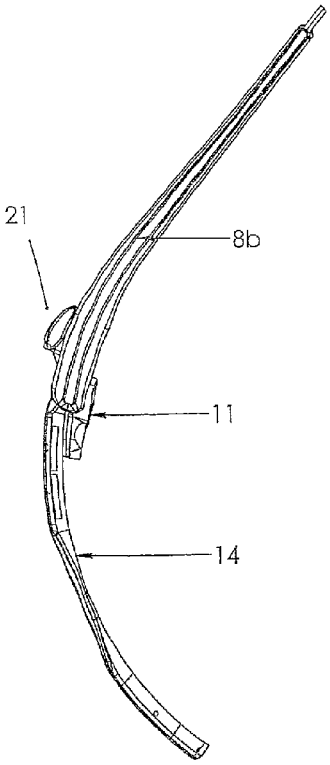
FIG. 5 is a side view of the fin fully open demonstrating more flex when kicking in water.
Figure 6:
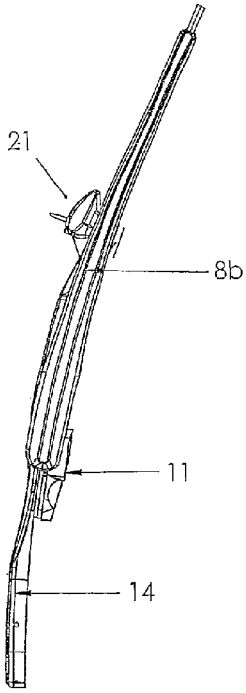
FIG. 6 is a side view of the fin halfway open demonstrating less flex when kicking in water.
Figure 7:
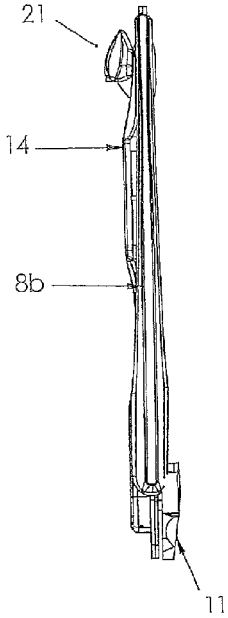
FIG. 7 is a side view of the fin fully closed.

As depicted in FIG. 2 and FIG. 3, the blades 8, 9 can be extended to create a variable surface area for different swimming situations, whereas normally swimmers must use entirely different fins. As depicted in FIG. 5 and FIG. 6 when extended, the composition and positioning of the attachment points of the blades 8, 9 allows the flexibility required for a swimming. As depicted in FIG. 4 and FIG. 7, the blades 8, 9 can also be locked under the foot plate 14 which allows for walking as in normal footwear meant for land-based use. With the blades 8, 9 locked under the foot plate 14, the walking surface is short enough to walk on normally.

Figure 14:
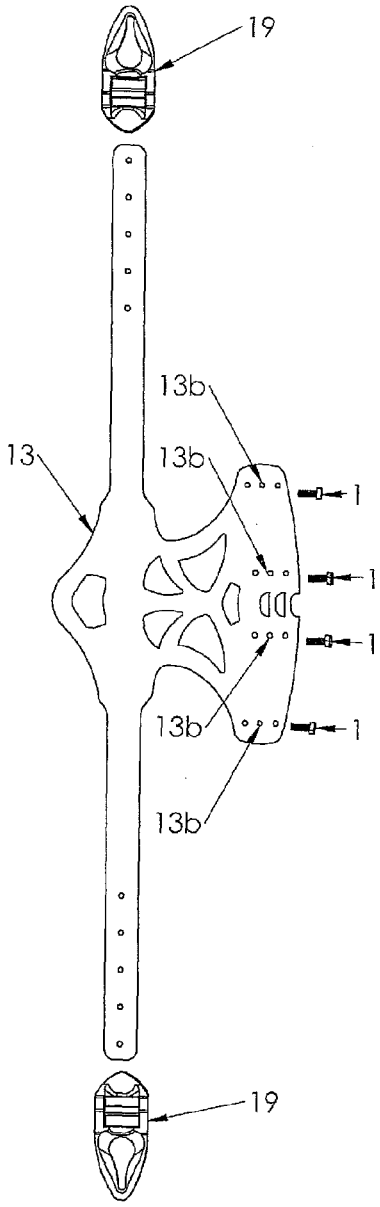
FIG. 14 is a plan view of the heel hilt assembly with buckles and heel screws.
Figure 16:
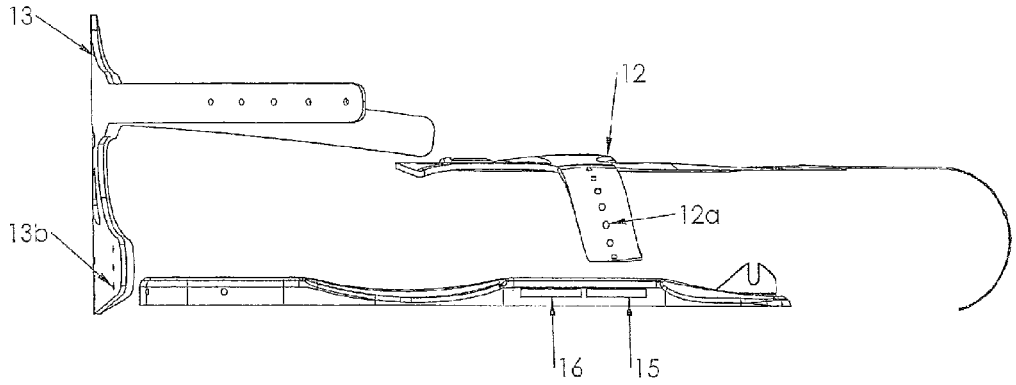
FIG. 16 is a side view of the foot plate, foot pocket and heel hilt demonstration forward slot for foot pocket and tallest setting for heel hilt, as appropriate for a large foot.
Figure 17:
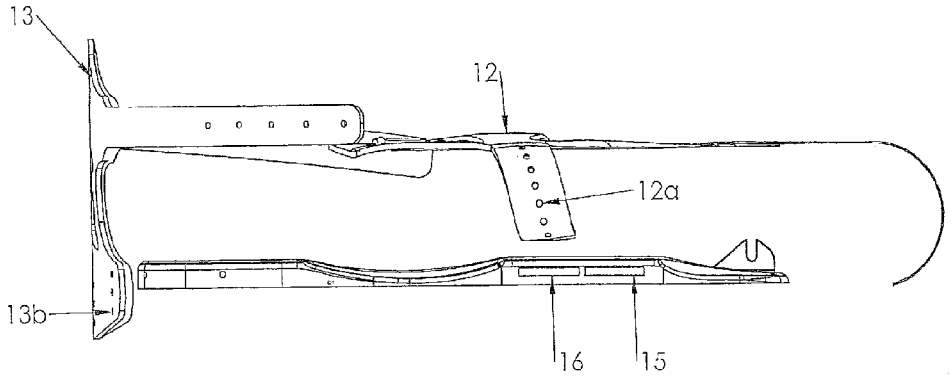
FIG. 17 is a side view of the foot plate, foot pocket and heel hilt demonstration rear slot for foot pocket and lowest lowest setting for heel hilt, as appropriate for a small foot.
Figure 18:
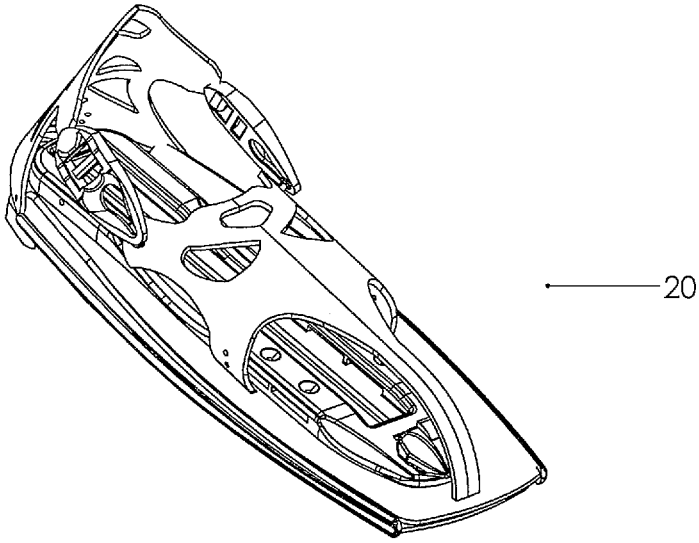
FIG. 18 is a plan view of the fin depicted as an unexploded whole.

The foot plate 14 is formed of polycarbonate and connects to the foot pocket 12 and heel hilt 13 to form the area in which the foot is inserted into the device. As depicted in FIG. 14, the heel hilt 13 is made of vulcanized rubber with nylon sub strait mesh and connects to the foot plate 14 by means of stainless steel heel hilt screws 1 inserted into the heel hilt strap holes 13*b* built into the heel hilt and screwed into appropriate holes in the foot plate 14. There are multiple sets of holes 13*b*, three in the depicted embodiment in FIG. 16 and FIG. 17, which allow for adjusting the heel hilt based on the size of the footwear the user is wearing. A rubber heel pad 11 is attached to the rear bottom of the foot plate 14. The heel pad 11 is meant to be kicked into the ground to hold the fin 20 steady as part of adjusting or removing the fin.

Figure 11:
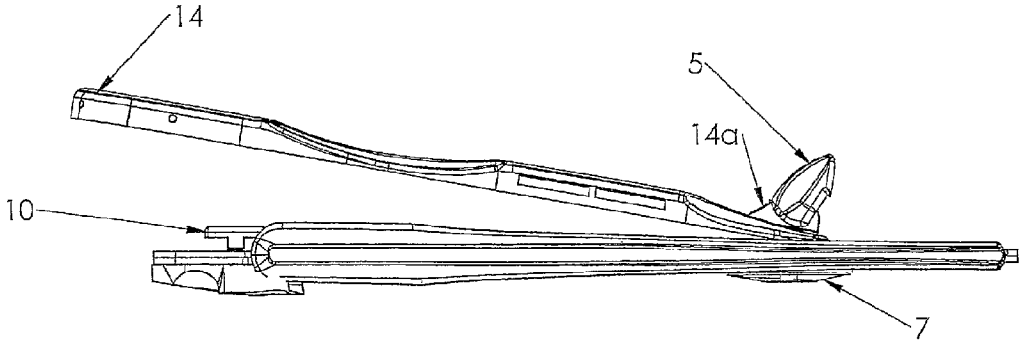
FIG. 11 is a side view of the boot plate raised away from blades demonstrating the T Bolt slider unlocked.
Figure 12:
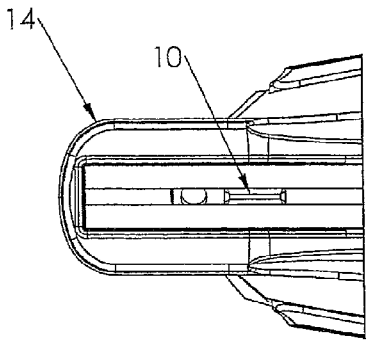
FIG. 12 is a top view of the foot plate with T Bolt slider in the unlock position.
Figure 13:
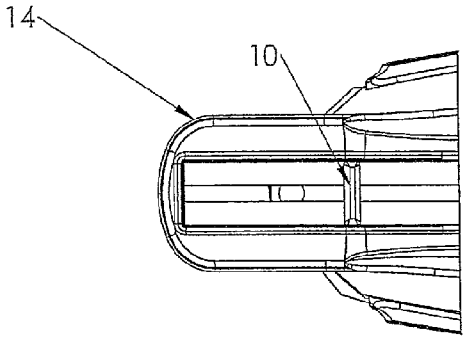
FIG. 13 is a top view of the foot plate with T Bolt slider in the lock position.

As depicted in FIG. 11, FIG. 12 and FIG. 13, the foot plate 14 contains the T-Bolt Slider 10 and T-Bolt slider track 17. The T-Bolt Slider 10 can be rotated 90 degrees to allow the blades 8, 9 to be quickly separated from the foot plate 14 without the use of tools and access the space between the blades 8, 9, which can be used to clear away debris. The T-Bolt Slider 10 can also be completely removed from between the blades themselves for the same function.

Figure 15:
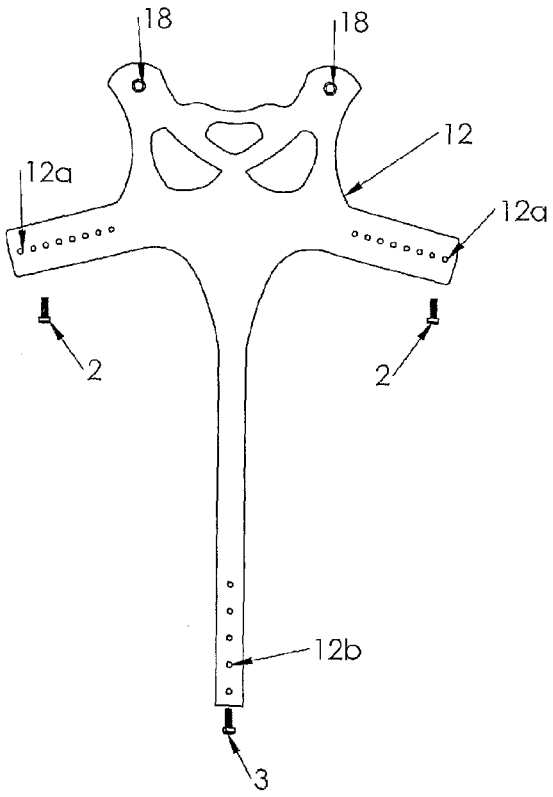
FIG. 15 is a plan view of the foot pocket assembly with buckle lugs and foot pocket screws.

As depicted in FIG. 15, the foot pocket 12 is made of vulcanized rubber with nylon sub strait mesh and attaches to the foot plate 14 by means of a pair of strips or "ears" 12*a* which are inserted into either the forward 15 or rear 16 foot pocket slots, depending on the size of the foot. These ears 12*a* are then fastened with stainless steel foot pocket screws 2. The foot pocket 12 is attached to the heel hilt 13 by means of polycarbonate buckles 19. The buckles 19 are fastened by inserting a lug 18 to fasten polycarbonate buckles 19 into the foot pocket 12. The buckles 19 have a large hole followed by a narrow track; the lug 18 is inserted into the large hole and slid through the narrow track to secure it. The buckle 19 is then tightened using multiple sets of holes 13*a* in heel hilt 13 to fit the foot and footwear chosen by the user. The foot pocket 12 also attaches to the cam lock system 21 by means of a pull lanyard 12*b* extending from the foot pocket 12, inserted through the cam lock system 21, then fastened with stainless steel foot pocket screw 3.

The cam lock system 21 is depicted in FIG. 8, FIG. 9, and FIG. 10. It consists of a polycarbonate cam lever 5 attached to a glass-filled nylon or delrin piston 6 and the cam base 14*a*. A stainless steel cam system screw 4 is inserted through the polycarbonate cam disc 7 at the bottom of the foot plate 14. When the cam lever 5 is locked, it prevents the extension or retraction of the blades 8, 9, thus allowing the fin 20 to be used for walking or swimming.

Although the invention has been described in connection with a preferred embodiment, it should be understood that various modifications, additions and alterations may be made to the invention by one skilled in the art without departing from the spirit and scope of the invention as defined in the appended claims.

What is claimed is:

1. An adjustable scuba fin apparatus, comprising:

an adjustable pair of fin blades each having a length and a track extending along the length said track comprised of a fully enclosed, substantially longitudinal elongated slot through each of the fin blades; and an adjustment system adapted to selectively allow the fin blades to extend and retract, said adjustment system having a fastening member combined with a foot plate, said fastening member inserted through the tracks and into a securing member, said fastening member adapted to ride within the tracks of the fin blades to guide the blades as they are retracted and extended.

2. The apparatus of claim 1, wherein a T-bolt slider is formed within a foot plate said T-bolt slider is adapted to receive a T-bolt which is combined with the fin blades so that the T-bolt slides within the T-bolt slider as the fin blades are extended and retracted.

3. The apparatus of claim 2, wherein the T-bolt slider has a head can be rotated to clear the space between the blades.

4. The apparatus of claim 2, further comprising an adjustable height heel hilt attached with screws to the foot plate.

5. The apparatus of claim 2, further comprising a foot pocket attached to the foot plate by adjustable straps.

6. The apparatus of claim 5, wherein the foot pocket is attached to the heel hilt by buckles.

7. The apparatus of claim 1, further comprising a foot pocket connected to the cam lock system.

8. The apparatus of claim 1 wherein the fastening member is a screw.

9. The apparatus of claim 1 wherein the securing member is a disk.

10. The apparatus of claim 1 wherein the fin blades have edges and wherein the tracks are fully enclosed so that they are formed within the fin blades but do not extend to the edges of the fin blades.

11. An adjustable scuba fin apparatus, comprising:

an adjustable pair of fin blades each having a length and a track extending along the length said track comprised of a fully enclosed, substantially longitudinal elongated slot through each of the fin blades;

a cam lock adjustment system adapted to selectively lock the fin blades in place, said cam lock adjustment system comprising a fastening member combined with a foot plate, said fastening member inserted through the tracks and into a securing member, said fastening member adapted to ride within the tracks of the fin blades to guide the blades as they are retracted and extended; and a foot pocket connected to the foot plate and the cam lock system, wherein the foot pocket is connected to the cam lock system by an adjustable pull lanyard.

12. The apparatus of claim 11 wherein the fastening member is a screw.

13. The apparatus of claim 11 wherein the securing member is a disk.

14. An adjustable scuba fin apparatus, comprising:

an adjustable pair of fin blades each having a length and a track extending along the length said track comprised of a fully enclosed, substantially longitudinal elongated slot through each of the fin blades;

a cam lock adjustment system adapted to selectively lock the fin blades in place, said cam lock adjustment system comprising a screw combined with a foot plate and inserted through the tracks and into a disc, said screw adapted to ride within the tracks of the fin blades to guide the blades as they are retracted and extended;

a track formed within the foot plate and adapted to receive a fastening member combined with the fin blades, wherein the fastening member slides within the track as the blades are retracted and extended.

15. The apparatus of claim 14 wherein the track is a T-bolt slider.

16. The apparatus of claim 15 wherein the fastening member is a T-bolt.

17. The apparatus of claim 16 wherein the T-bolt has a rotatable head having a first position wherein it is generally perpendicular to the T-bolt slider for securing the fin blades to the foot plate and a second position wherein it is generally parallel to the T-bolt slider for allowing the T-bolt head to fit through the T-bolt slider to separate the fin blades from the foot plate.

* * * * *